US005339804A

United States Patent [19]

Kemp

[11] Patent Number: 5,339,804

[45] Date of Patent: Aug. 23, 1994

[54] ULTRASONIC BATHING SYSTEM

[75] Inventor: William H. Kemp, Carleton Place, Canada

[73] Assignee: Amada Technologies Inc., Mississauga, Canada

[21] Appl. No.: 105,676

[22] Filed: Aug. 13, 1993

[51] Int. Cl.[5] ..... A61H 1/00

[52] U.S. Cl. ..... 601/2

[58] Field of Search ..... 128/24 AA, 66; 422/20; 73/610

[56] References Cited

U.S. PATENT DOCUMENTS

| | | | |
|---|---|---|---|
| 2,970,073 | 1/1961 | Prange | 128/24 AA |
| 3,499,436 | 3/1970 | Balamuth | 128/24 AA |
| 3,867,929 | 2/1975 | Joyner et al. | 128/66 |
| 3,982,426 | 9/1976 | Newhouse et al. | 73/610 |
| 4,308,229 | 12/1981 | Voit | 422/20 |
| 5,048,520 | 9/1991 | Vago | 128/24 AA |

*Primary Examiner*—Angela D. Sykes
*Assistant Examiner*—George Manuel

[57] ABSTRACT

An ultrasonic bathing system comprising a bathtub for containing a bathing fluid, an ultrasonic transducer mounted on said bath, means for energizing said transducer to generate ultrasonic waves in the bathing fluid at a power and frequency for providing a mechanical cleaning action, and means for pulsing said energizing means to provide bursts of constant amplitude waves having a mark-space ratio dependent on the required power level.

5 Claims, 2 Drawing Sheets

ULTRASONIC BATHING SYSTEM

BACKGROUND OF THE INVENTION

This invention relates to an ultrasonic bathing system.

Ultrasonic bathing systems have been known for some time. One such system is described in U.S. Pat. No. 5,048,520 of Sep. 17, 1991. This patent claims to describe an ultrasonic bathing system employing a power level of between 0.1 and 5 watts per square centimeter at a time of less than 15 minutes, with the frequency being swept through a predetermined sweep frequency band. The alleged reason for employing a swept frequency generator is that if a constant frequency is employed, standing waves will be set up within the bathtub and these will cause distributed regions of high and low intensity within the bathing fluid.

The above patent makes several claims concerning the germicidal effects of ultrasonic systems and also the significance of cavitation about which the present applicants are skeptical. Nonetheless, it is believed that the establishment of ultrasonic waves within a bathing fluid can serve to exert a mechanical cleaning action on an immersed item, whether it be a mechanical component or a human body. The advantage of ultrasonic systems, as opposed to pumped flow systems, is that after each use the bathing fluid can be completely drained from the bathtub. There are no pipes connecting the bathtub to a pumping system that can serve to retain harmful bacteria.

While ultrasonic bathing systems have certain advantages over conventional whirlpool systems, a problem remains as to how to adjust the power level of the ultrasonic energy within the bathing system without effecting the cleaning efficiency. If a conventional signal generator is employed and the power level turned down, this merely reduces the amplitude of the wave applied to the bathing system.

Since the cleaning action of ultrasonic energy is dependent on the resulting mechanical agitation, the agitation caused by the wave is less at a lower amplitude and the cleaning efficiency suffers. Indeed, below certain power levels, the ultrasonic energy is really insufficient to create a mechanical cleaning action. Yet, there are many situations where it is desirable to reduce the overall power level. For example, elderly patients or patients with serious wounds may require more gentle treatment than patients having a stronger constitution. The problem is, that treatment at a reduced power level may in fact be no treatment at all if the mechanical agitation caused by the ultrasonic energy is insufficient to dislodge attached debris.

SUMMARY OF THE INVENTION

An object of the present invention is to provide an improved ultrasonic bathing system of simplified construction.

According to the present invention there is provided an ultrasonic bathing system comprising a bathtub for containing a bathing fluid, an ultrasonic transducer mounted on said bath, means for energizing said transducer to generate ultrasonic waves in the bathing fluid at a power and frequency for providing a mechanical cleaning action, and means for pulsing said energizing means to provide bursts of constant amplitude waves having a mark-space ratio dependent on the required power level.

In accordance with the invention, the power supplied to the bathtub can be varied by varying the mark-space ratio of the burst of ultrasonic energy. By ensuring that the frequency and amplitude of the waves are kept constant, a uniform cleaning action can be assured.

The fact that the energy is supplied in bursts also helps to reduce the formation of standing waves within the bathtub, although at full power a continuous constant amplitude wave is supplied to the bathtub and the applicant has found that standing wave formation does not present a serious problem at such power levels.

BRIEF DESCRIPTION OF THE DRAWINGS

The invention will now be described in more detail, by way of example only, with reference to the accompanying drawings, in which.

DESCRIPTION OF THE PREFERRED EMBODIMENTS

Figure 1:
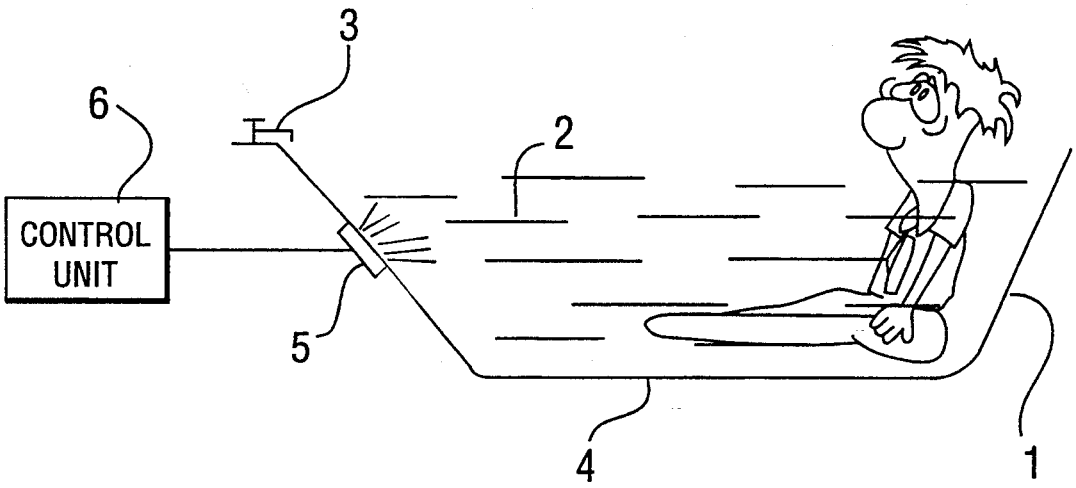
FIG. 1 is a diagrammatic view of an ultrasonic bathing system in accordance with the invention.

Referring now to FIG. 1, a conventional bathtub 1 contains water 2 and is provided at one end with a standard faucet arrangement 3. The bath has a plug hole 4, but is otherwise closed and does not have water flow conduits, such as would be required in a whirlpool-type system.

At one end of the bath, an aperture is formed in the bathtub and a steel plate forming part of an ultrasonic transducer 5 is firmly bolted around its periphery to the wall of the bathtub. The transducer 5 is connected to a control unit 6, which supplies constant amplitude ultrasonic energy to the transducer 5. In a manner that will be described, the ultrasonic energy supplied to the transducer can be supplied in the form of short duration bursts having a variable mark-space ratio so as to permit control of the mean power level supplied to the water. However, because the amplitude of the wave within the burst remains constant, the cleaning efficiency at reduced power levels is substantially unaffected.

If a continuous wave were used, and the energy was varied by varying the amplitude of the wave, at low power levels there would be very little cleaning action because of the minimal agitation caused by the low amplitude wave. In other words, in accordance with the invention, it is more efficient to intersperse periods of constant high energy with period of zero energy, in order to reduce the mean power level, than to have a continuous supply of energy at a lower amplitude, which causes less agitation of the medium to be cleaned.

Figure 2:
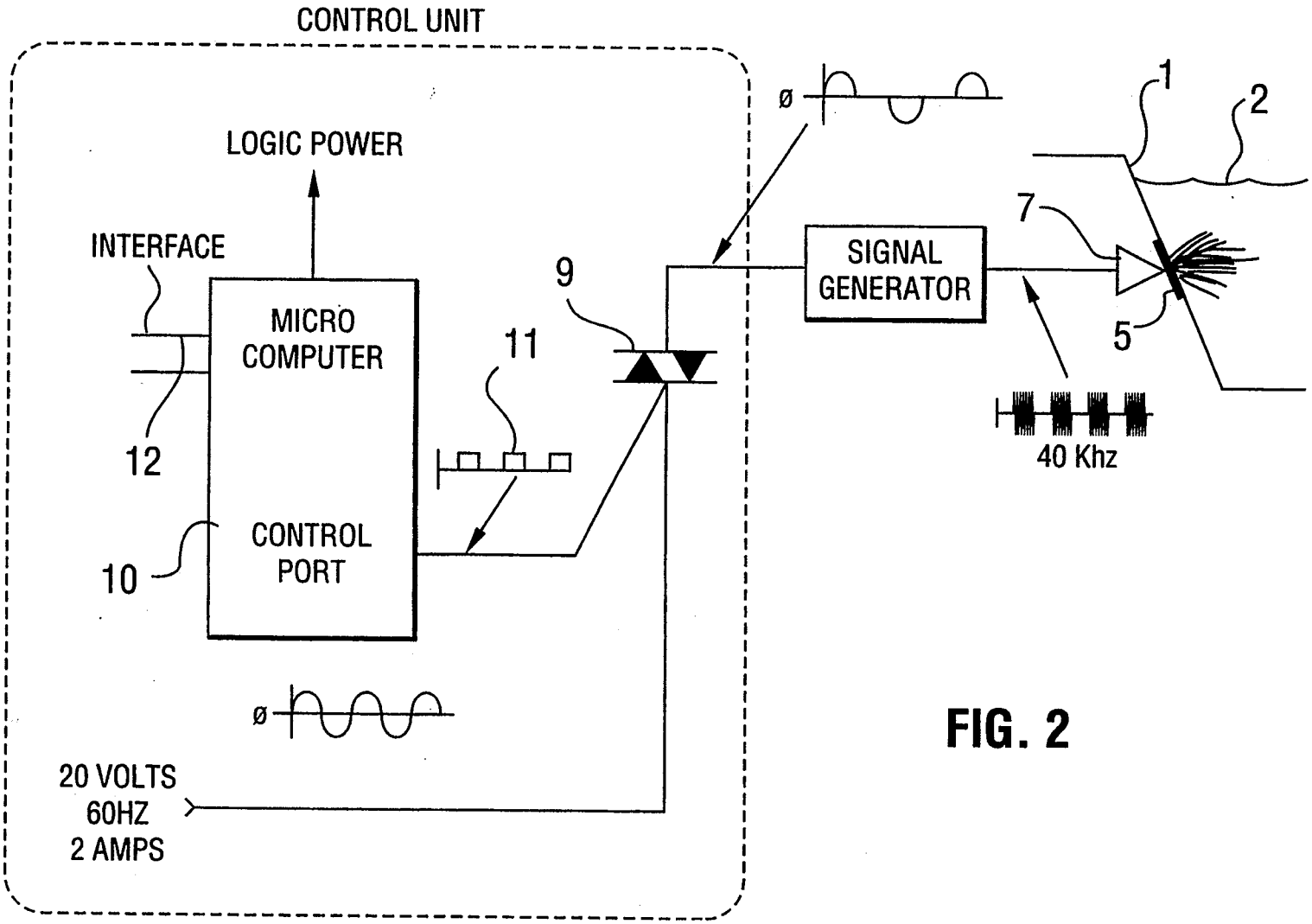
FIG. 2 is a circuit diagram of a signal generator or the ultrasonic transducer of the system shown in FIG. 1.

FIG. 2 illustrates the control circuitry in more detail. The transducer plate 5 is attached to a transducer 7, which can be for example a transducer made by American Ultrasonics.

This is connected to a American Ultrasonics 40 khz signal generator 8, which when energized produces a constant amplitude wave at 100±10% volts for energizing the transducer 7.

In order to regulate the power level, the 120 V, 60 hz, 2 amp main supply is fed to the signal generator 8 through a zero crossing power triac 9, type Motorola MAC 222. This is triggered from the control port of a microcomputer 10, type Motorola 68MC05C8P, which produces a train of pulses 11 having a repetition rate dependent on the desired output power level. The microcomputer is connected through a serial interface 11 to a double insulated user control panel.

The train of output pulses 11 triggers the triac to allow selected portions of the mains voltage cycle through to the signal generator 8. In the illustrated example shown in FIG. 2, alternate half cycles pass through the triac 9, which causes the signal generator 8 to produce bursts of energy 13 during alternate half cycles. As a result, the mean power level supplied to the bath 2 is 50% of the power level supplied when a continuous wave is generated, but the amplitude within the burst remains constant so that the cleaning action is unaffected.

In addition to controlling the power supply circuits to the transducer, the microcomputer 11 also controls the time of operation of the bath and displays information to the user in the bath water about the tub status, for example programming length of bath and power (duty cycle).

The system in accordance with the invention provides a practical ultrasonic bathing system that requires the minimum number of components. The bathtub 1 is essentially conventional with the exception of the transducer plate attached at one end. No special plumbing is required, as for instance would be the case with a whirlpool.

The present invention provides convenient means of adjusting the mean power level of ultrasonic energy supplied to the bathtub without detrimentally effecting the cleaning action.

I claim:

1. An ultrasonic bathing system comprising a bathtub for containing a bathing fluid, an ultrasonic transducer mounted on said bathtub for supplying ultrasonic energy to the bathing fluid, means for energizing said transducer to generate ultrasonic waves in the bathing fluid at a power level and frequency for providing a mechanical cleaning action, and means for pulsing said energizing means to provide bursts of substantially constant amplitude waves at a set mark-space ratio, and a device for varying said mark-space ratio to vary the power level of ultrasonic energy supplied to said bathing fluid.

2. An ultrasonic bathing system as claimed in claim 1, wherein the frequency of said ultrasonic waves in the range of 30–60 Khz, and the power level is less than about 0.01 watts/cm$^2$ of bathing fluid.

3. An ultrasonic bathing system as claimed in claim 2, wherein the frequency is 40 khz.

4. An ultrasonic bathing system comprising a bathtub for containing a bathing fluid, an ultrasonic transducer mounted on said bathtub for supplying ultrasonic energy to the bathing fluid, means for energizing said transducer to generate ultrasonic waves in the bathing fluid at a power and frequency for providing a mechanical cleaning action, and means for pulsing said energizing means to provide bursts of substantially constant amplitude waves having a mark-space ratio dependent on the required power level, and a microcomputer for setting the mark-space ratio required for a given output power.

5. An ultrasonic bathing system as claimed in claim 4, wherein said microcomputer generates a train of pulses that trigger a triac connected to said energizing means.

* * * * *